US006793150B2

(12) United States Patent
Schaupp et al.

(10) Patent No.: US 6,793,150 B2
(45) Date of Patent: Sep. 21, 2004

(54) BELL CUP POST

(75) Inventors: John Schaupp, Toledo, OH (US); David M. Seitz, Riga, MI (US)

(73) Assignee: Illinois Tool Works, Inc., Glenview, IL (US)

( * ) Notice: Subject to any disclaimer, the term of this patent is extended or adjusted under 35 U.S.C. 154(b) by 153 days.

(21) Appl. No.: 10/236,486

(22) Filed: Sep. 6, 2002

(65) Prior Publication Data

US 2003/0230650 A1 Dec. 18, 2003

Related U.S. Application Data

(60) Provisional application No. 60/385,402, filed on Jun. 3, 2002.

(51) Int. Cl.[7] ..... B05B 3/10; B05B 1/34

(52) U.S. Cl. ..... 239/224; 239/489; 239/690.1; 239/490; 239/522

(58) Field of Search ..... 239/224, 398, 239/690, 690.1, 399, 406, 589, 536, 461, 463, 489, 490, 512, 522

(56) References Cited

U.S. PATENT DOCUMENTS 4,270,486 A * 6/1981 Leverenz ..... 118/679
4,834,589 A * 5/1989 Dietrich ..... 406/109
4,893,737 A * 1/1990 Borjesson ..... 222/360
5,683,976 A * 11/1997 Colurciello et al. ..... 510/278
5,768,800 A 6/1998 Merritt et al.
5,853,126 A 12/1998 Alexander
6,144,570 A 11/2000 Hughey
6,328,224 B1 12/2001 Alexander

* cited by examiner

*Primary Examiner*—Davis Hwu
(74) *Attorney, Agent, or Firm*—Barnes & Thornburg

(57) ABSTRACT

A dispensing apparatus is provided for a pulverulent material entrained in a stream of a transporting gas or mixture of gases. The apparatus includes a first member and a second member. The first member includes an interior into which the stream flows and a perimetral discharge edge. The second member includes a side facing the interior and a perimetral discharge edge. A discharge opening is defined between the discharge edges of the first and second members. A dimension of the discharge opening is determined by one or more third members. Each third member has a first end adjacent the first member and a second end adjacent the second member. The third members have non-uniform transverse sections. A transverse section of each third member between its first and second ends has a smaller area than the transverse section of each third member at one its first and second ends.

33 Claims, 2 Drawing Sheets

BELL CUP POST

REFERENCE TO RELATED APPLICATIONS

This Application claims benefit of the Provisional Application 60/385,402 filed Jun. 3, 2002.

FIELD OF THE INVENTION

This invention relates to dispensers for dispensing pulverulent coating materials (hereinafter sometimes "coating powder" or "powder") suspended in gas streams, for example, stream of air, from, for example, a fluidized powder bed. It is disclosed in the context of a rotary powder dispenser (hereinafter sometimes a "powder bell" or "bell"). However, it is believed to have utility in other applications as well.

BACKGROUND OF THE INVENTION

Systems for dispensing coating powder are known. There are, for example, the systems illustrated and described in U.S. Pat. Nos. 5,853,126 and 6,328,224 and the references cited in those patents. The powder bells illustrated and described in U.S. Pat. Nos. 5,853,126 and 6,328,224 employ electrically nonconductive sleeves or bosses provided on the back side (upstream side in the direction of powder flow) of the diffuser to determine the width of the annular powder discharge opening.

DISCLOSURE OF THE INVENTION

According to an aspect of the invention, a dispensing apparatus is provided for a pulverulent material entrained in a stream of a transporting gas or mixture of gases. The apparatus includes a first member and a second member. The first member includes an interior into which the stream flows and a perimetral discharge edge. The second member includes a side facing the interior and a perimetral discharge edge. A discharge opening is defined between the discharge edges of the first and second members. A dimension of the discharge opening is determined by one or more third members, each having a first end adjacent the first member and a second end adjacent the second member. The third members have non-uniform transverse sections. A transverse section of each third member between its first and second ends has a smaller area than the transverse section of each third member at one its first and second ends.

Illustratively according to this aspect of the invention, a transverse section of each third member between its first and second ends has a smaller area than the transverse section of each third member at both its first and second ends.

Further illustratively according to this aspect of the invention, one of the first member and each first end includes a first threaded opening and the other of the first member and each first end includes complementary first threads for engagement in the first threaded opening. One of the second member and each second end includes a second threaded opening and the other of the second member and each second end includes complementary second threads for engagement in the second threaded opening.

Additionally illustratively according to this aspect of the invention, the apparatus includes a rotator for rotating the assembled first, second and third members about an axis of the first member.

Illustratively according to this aspect of the invention, the apparatus includes a source of high-magnitude electrical potential for providing an electrical charge to the fluidized pulverulent material as the fluidized pulverulent material is discharged. An electrode is provided on the assembled first, second and third members. Means are provided for coupling the source of high-magnitude electrical potential to the electrode.

Further illustratively according to this aspect of the invention, the apparatus includes a device for providing a fluidized stream of the pulverulent material, and a conduit for transporting the fluidized pulverulent material from the device to the interior.

Additionally illustratively according to this aspect of the invention, the first member includes an outer portion defining an exterior of the first member and a liner defining the interior.

Illustratively according to this aspect of the invention, the assembled first, second and third members include a first feature and the electrode includes a second feature complementary to the first feature for orienting the electrode with respect to the assembled first, second and third members.

Additionally illustratively according to this aspect of the invention, one of the first member and each first end includes a first threaded opening and the other of the first member and each first end includes complementary first threads for engagement in the first threaded opening. The first end includes a radially outwardly extending feature for abutting against the first member adjacent the engaged complementary first threads and first threaded opening.

Illustratively according to this aspect of the invention, one of the second member and each second end includes a second threaded opening and the other of the second member and each second end includes complementary second threads for engagement in the second threaded opening. The second end includes a radially outwardly extending feature for abutting against the second member adjacent the engaged complementary second threads and second threaded opening.

Further illustratively according to this aspect of the invention, one of the first member and each first end includes a frustoconical feature and the other of the first member and each first end includes a complementary recess for receiving the frustoconical feature.

Additionally illustratively according to this aspect of the invention, one of the second member and each second end includes a frustoconical feature and the other of the second member and each second end includes a complementary recess for receiving the frustoconical feature.

BRIEF DESCRIPTION OF THE DRAWINGS

The invention may best be understood by referring to the following detailed description and accompanying drawings which illustrate the invention. In the drawings.

DETAILED DESCRIPTIONS OF ILLUSTRATIVE EMBODIMENTS

Figure 1:
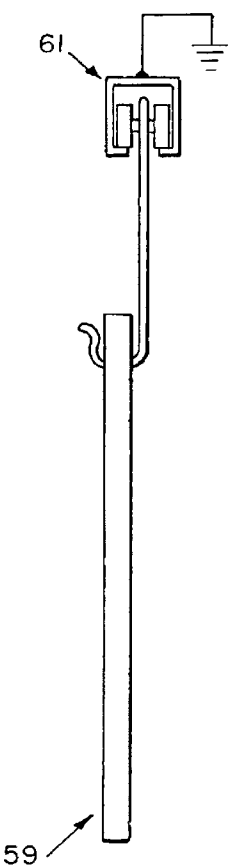
FIG. 1 illustrates a system constructed according to an aspect of the invention, with a component of the system illustrated in sectional side elevational view, and other components of the system illustrated diagrammatically.
Figure 1:
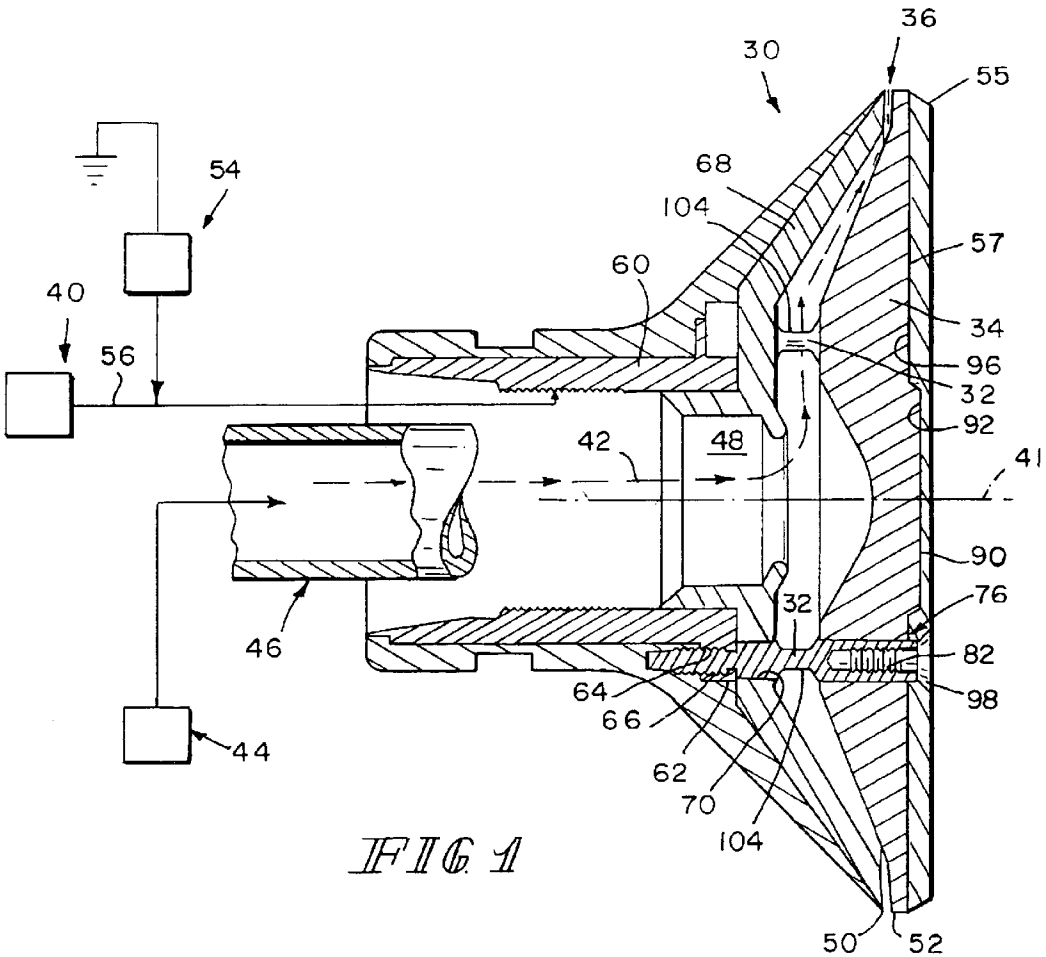
Figure 2:
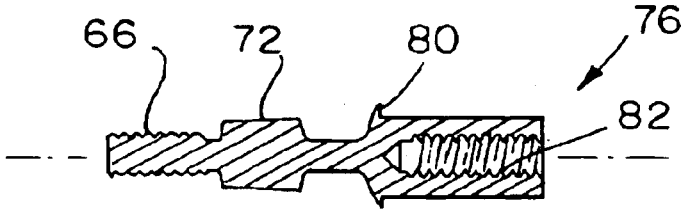
FIG. 2 illustrates a sectional side elevational view of a detail of the component illustrated in FIG. 1; and, FIG. 3 illustrates a sectional side elevational view of an alternative detail to the detail illustrated in FIG. 2.
Figure 3:
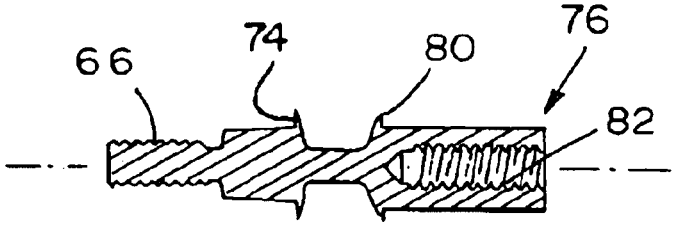

The present invention is intended to improve upon powder bell designs of this type by providing a post of reduced cross section supports the diffuser in front of the powder bell cup and provides the annular space between the cup and diffuser through which the powder is dispensed.

An electrically conductive post is provided in the circuit between a source of high-magnitude electrostatic potential and a charging electrode for the powder.

An electrically conductive post is provided in the flow of the powder toward an annular space defined between the bell cup and the diffuser, through which annular opening the powder is dispensed.

The illustrated and described powder bell cup 30 is intended to improve upon powder bell designs of the type illustrated and described in U.S. Pat. Nos. 5,853,126 and 6,328,224 and the references cited in those patents. The illustrated and described powder bell cup 30 seeks to achieve this objective by providing a post 32 of reduced cross section in the path of powder flow from the cup 30. The functions of the posts 32 in the powder bell cup 30 include supporting the diffuser 34 at the front of the powder bell cup 30 to define the annular opening 36. The illustrated and described post 32 configuration for a powder bell cup 30 is also intended to provide electrically conductive members 32 in the flow of the powder toward the annular opening 36.

The powder bell cup 30 is mounted on a turbine 40 of any of a number of known types, for example, one of the general type illustrated and described in U.S. Pat. Nos. 5,853,126 and 6,328,224. Turbine 40 rotates the cup 30 about the cup 30's axis 41. Powder entrained in a stream 42 of a transporting gas, such as a stream of air, is pumped from a source 44, such as, for example, a fluidized bed containing the powder to be dispensed, through a conduit 46 to the back 48 of the bell cup 30. The source 44 may be one of any of a number of known types, for example, a fluidized bed of the general type illustrated and described in U.S. Pat. No. 5,768,800. The powder streams 42 from the conduit 46, through the opening 36 defined between the axially forward and radially outward extent, or edge, 50 of the bell cup 30 and the radially outward extent, or edge, 52 of the diffuser 34, and out through the annular opening 36.

The posts 32 are in the powder stream 42. The posts 32 set the width of the annular opening 36 through which the air-entrained powder 42 is dispensed. The posts 32 also couple a high-magnitude potential source 54 to the final charging electrode 55 provided on the forward face 57 of the diffuser 34, that is, the face 57 facing generally toward an article 59 to be coated by the powder dispensed from the bell cup 30. The exposure of the streaming powder 42 to the electrically charged, electrically conductive posts 32 and electrode 55 results in charge being imparted upon the powder as it is being dispensed, with the result that the powder is attracted toward the article 59 which is maintained at low-magnitude, for example, ground, electrical potential.

The article 59 is maintained at low-magnitude electrical potential by, for example, transporting the article 59 past the bell cup 30 on a grounded conveyor 61. The electrical charge is provided by, for example, a high-magnitude electrostatic potential supply 54 of any of a number of known types, for example, one of the general type illustrated and described in U.S. Pat. No. 5,978,244 or U.S. Pat. No. 6,144,570. The power supply 54 is coupled to an electrically conductive component 56 of the turbine 40, for example, the turbine 40's output shaft, which, in turn, is coupled to the posts 32 through an electrically conductive component 60 of the bell cup 30, such as its shaft 56-receiving sleeve. Sleeve 60 is provided with a flange 62 or the like including threaded openings 64 for receiving complementary threads 66 on the posts 32. During assembly, a cup 30 liner 68 of the general type described in U.S. Pat. Nos. 5,853,126 and 6,328,224 is inserted into the bell cup 30. Then, a plurality of posts 32, illustratively three, are inserted through openings 70 provided therefor in liner 68 and threaded 66 into openings 64 in flange 62.

A somewhat frustoconical feature 72, an integral mechanical feature 74, or both, on the posts 32 position the liner 68 against the inside of the cup 30. The illustrative mechanical feature 74 is a web or flange which extends radially outward from the axis of post 32. Then the diffuser 34 is placed on the forward ends 76 of the posts 32, illustratively with the aid of mechanical features 80 provided on the forward ends 76 of the posts 32. Again, mechanical features 80 illustratively are webs or flanges which extend radially outward from the axes of posts 32. The forward ends 76 of the posts 32 are provided with axial, threaded openings 82. The plate-like charging electrode 55 is located on the forward face 57 of the diffuser 34, illustratively with the aid of features 90, 92, such as a boss 90 and relief 92 formed on the facing surfaces 57, 96 of the diffuser 34 and charging electrode 55. Then, electrically conductive screws 98 are threaded into the threaded openings 82 in the forward ends of posts 32 to secure the diffuser 34 and electrode 55 to the bell cup 30 and electrically couple electrode 55 through posts 32, sleeve 60 and shaft 56 to supply 54.

The posts 32 establish the width of the annular opening 36, support the diffuser 34 and the charging electrode 55 on the front of the diffuser 34, and provide a conductive path 56, 60, 62, 32, 98 from the high magnitude potential source 54 to the electrode 55, in order to charge the powder streaming 42 through the annular opening 36. Each post 32 helps set the width of the annular opening 36 by virtue of (a) mechanical stop(s) 80, 74, respectively, at its diffuser 34 end, at its cup 30 end, or both. A frustoconically-shaped feature 72 can also or alternatively be provided at one or the other or both ends of the posts 32. This construction permits the diameter of the post 32 in the path 42 of the powder to be reduced. This reduction of the diameter of the post 32 reduces the effect of the post 32 on the powder stream 42. Less powder tends to collect on the downstream sides 104 of the posts 32. This is significant because powder that collects on the downstream sides 104 of the posts 32 tends to dislodge at a later time and can exit through the annular opening 36. In some cases, the thus-dislodged powder will be deposited on articles 59 being coated, causing a blemish or defect in the powder coating.

What is claimed is:

1. A dispensing apparatus for a pulverulent material entrained in a stream of a transporting gas or mixture of gases, the apparatus including a first member and a second member, the first member including an interior into which the stream flows and a perimetral discharge edge, the second member including a side facing the interior and a perimetral discharge edge, a discharge opening defined between the discharge edges of the first and second members, a dimension of the discharge opening being determined by one or more third members, each third member having a first end adjacent the first member and a second end adjacent the second member, the third members having non-uniform transverse sections, a transverse section of each third member between its first and second ends having a smaller area than the transverse section of each third member at one its first and second ends.

2. The apparatus of claim 1 wherein a transverse section of each third member between its first and second ends has a smaller area than the transverse section of each third member at both its first and second ends.

3. The apparatus of claim 1 wherein one of the first member and each first end includes a first threaded opening and the other of the first member and each first end includes complementary first threads for engagement in the first threaded opening, and one of the second member and each second end includes a second threaded opening and the other of the second member and each second end includes complementary second threads for engagement in the second threaded opening.

4. The apparatus of claim 1 further including a rotator for rotating the assembled first, second and third members about an axis of the first member.

5. The apparatus of claim 4 further including a source of high-magnitude electrical potential, an electrode provided on the assembled first, second and third members, and means for coupling the source of high-magnitude electrical potential to the electrode.

6. The apparatus of claim 4 further including a device for providing a fluidized stream of the pulverulent material, and a conduit for transporting the fluidized pulverulent material from the device to the interior.

7. The apparatus of claim 6 further including a source of high-magnitude electrical potential, an electrode provided on the assembled first, second and third members, and means for coupling the source of high-magnitude electrical potential to the electrode.

8. The apparatus of claim 1 further including a device for providing a fluidized stream of the pulverulent material, and a conduit for transporting the fluidized pulverulent material from the device to the interior.

9. The apparatus of claim 1 wherein the first member includes an outer portion defining an exterior of the first member and a liner defining the interior.

10. The apparatus of claim 9 wherein the assembled first, second and third members include a first feature and the electrode includes a second feature complementary to the first feature for orienting the electrode with respect to the assembled first, second and third members.

11. The apparatus of claim 1 further including a source of high-magnitude electrical potential, an electrode provided on the assembled first, second and third members, and means for coupling the source of high-magnitude electrical potential to the electrode.

12. The apparatus of claim 1 wherein one of the first member and each first end includes a first threaded opening and the other of the first member and each first end includes complementary first threads for engagement in the first threaded opening, and the first end includes a radially outwardly extending feature for abutting against the first member adjacent the engaged complementary first threads and first threaded opening.

13. The apparatus of claim 12 wherein one of the second member and each second end includes a second threaded opening and the other of the second member and each second end includes complementary second threads for engagement in the second threaded opening, and the second end includes a radially outwardly extending feature for abutting against the second member adjacent the engaged complementary second threads and second threaded opening.

14. The apparatus of claim 1 wherein one of the first member and each first end includes a frustoconical feature and the other of the first member and each first end includes a complementary recess for receiving the frustoconical feature.

15. The apparatus of claim 14 wherein one of the second member and each second end includes a second threaded opening and the other of the second member and each second end includes complementary second threads for engagement in the second threaded opening, and the second end includes a radially outwardly extending feature for abutting against the second member adjacent the engaged complementary second threads and second threaded opening.

16. The apparatus of claim 1 wherein one of the second member and each second end includes a second threaded opening and the other of the second member and each second end includes complementary second threads for engagement in the second threaded opening, and the second end includes a radially outwardly extending feature for abutting against the second member adjacent the engaged complementary second threads and second threaded opening.

17. The apparatus of claim 1 wherein one of the second member and each second end includes a frustoconical feature and the other of the second member and each second end includes a complementary recess for receiving the frustoconical feature.

18. A dispensing apparatus for a pulverulent material entrained in a stream of a transporting gas or mixture of gases, the apparatus including a first member and a second member, the first member including an interior into which the stream flows and a perimetral discharge edge, the second member including a side facing the interior and a perimetral discharge edge, a discharge opening defined between the discharge edges of the first and second members, a dimension of the discharge opening being determined by one or more third members, each third member having a first end adjacent the first member and a second end adjacent the second member, the third members having non-uniform transverse sections, a transverse section of each third member between its first and second ends having a smaller area than the transverse section of each third member at one its first and second ends, and a rotator for rotating the assembled first, second and third members about an axis of the first member.

19. The apparatus of claim 18 further including a source of high-magnitude electrical potential, an electrode provided on the assembled first, second and third members, and means for coupling the source of high-magnitude electrical potential to the electrode.

20. The apparatus of claim 18 wherein one of the first member and each first end includes a first threaded opening and the other of the first member and each first end includes complementary first threads for engagement in the first threaded opening, and the first end includes a radially outwardly extending feature for abutting against the first member adjacent the engaged complementary first threads and first threaded opening.

21. The apparatus of claim 20 wherein one of the second member and each second end includes a second threaded opening and the other of the second member and each second end includes complementary second threads for engagement in the second threaded opening, and the second end includes a radially outwardly extending feature for abutting against the second member adjacent the engaged complementary second threads and second threaded opening.

22. The apparatus of claim 18 wherein one of the first member and each first end includes a frustoconical feature and the other of the first member and each first end includes a complementary recess for receiving the frustoconical feature.

23. The apparatus of claim 22 wherein one of the second member and each second end includes a second threaded opening and the other of the second member and each second end includes complementary second threads for engagement in the second threaded opening, and the second end includes a radially outwardly extending feature for abutting against the second member adjacent the engaged complementary second threads and second threaded opening.

24. The apparatus of claim 18 wherein one of the second member and each second end includes a second threaded opening and the other of the second member and each second end includes complementary second threads for engagement in the second threaded opening, and the second end includes a radially outwardly extending feature for abutting against the second member adjacent the engaged complementary second threads and second threaded opening.

25. The apparatus of claim 18 wherein one of the second member and each second end includes a frustoconical feature and the other of the second member and each second end includes a complementary recess for receiving the frustoconical feature.

26. A dispensing system including a device for providing a fluidized stream of a pulverulent material entrained in a stream of a transporting gas or mixture of gases, a dispensing apparatus including a first member and a second member, the first member including an interior, a conduit for transporting the fluidized pulverulent material from the device to the interior, the first member further including a perimetral discharge edge, the dispensing apparatus further including a second member having a side facing the interior and a perimetral discharge edge, a discharge opening defined between the discharge edges of the first and second members, a dimension of the discharge opening being determined by one or more third members, each third member having a first end adjacent the first member and a second end adjacent the second member, the third members having non-uniform transverse sections, a transverse section of each third member between its first and second ends having a smaller area than the transverse section of each third member at one its first and second ends.

27. The system of claim 26 further including a source of high-magnitude electrical potential, an electrode provided on the assembled first, second and third members, and means for coupling the source of high-magnitude electrical potential to the electrode.

28. The apparatus of claim 26 wherein one of the first member and each first end includes a first threaded opening and the other of the first member and each first end includes complementary first threads for engagement in the first threaded opening, and the first end includes a radially outwardly extending feature for abutting against the first member adjacent the engaged complementary first threads and first threaded opening.

29. The apparatus of claim 28 wherein one of the second member and each second end includes a second threaded opening and the other of the second member and each second end includes complementary second threads for engagement in the second threaded opening, and the second end includes a radially outwardly extending feature for abutting against the second member adjacent the engaged complementary second threads and second threaded opening.

30. The apparatus of claim 26 wherein one of the first member and each first end includes a frustoconical feature and the other of the first member and each first end includes a complementary recess for receiving the frustoconical feature.

31. The apparatus of claim 30 wherein one of the second member and each second end includes a second threaded opening and the other of the second member and each second end includes complementary second threads for engagement in the second threaded opening, and the second end includes a radially outwardly extending feature for abutting against the second member adjacent the engaged complementary second threads and second threaded opening.

32. The apparatus of claim 26 wherein one of the second member and each second end includes a second threaded opening and the other of the second member and each second end includes complementary second threads for engagement in the second threaded opening, and the second end includes a radially outwardly extending feature for abutting against the second member adjacent the engaged complementary second threads and second threaded opening.

33. The apparatus of claim 26 wherein one of the second member and each second end includes a frustoconical feature and the other of the second member and each second end includes a complementary recess for receiving the frustoconical feature.

* * * * *